US006604476B2

(12) United States Patent
Valle et al.

(10) Patent No.: US 6,604,476 B2
(45) Date of Patent: Aug. 12, 2003

(54) SEWING MACHINE FOR FORMING RUNNING-STITCH SEAMS, WITH HIGHLY REGULAR STITCH FORMING

(75) Inventors: Mario Valle, Pavia (IT); Ferruccio Perego, Milan (IT)

(73) Assignee: Conti Complett S.p.A., Milan (IT)

( * ) Notice: Subject to any disclaimer, the term of this patent is extended or adjusted under 35 U.S.C. 154(b) by 0 days.

(21) Appl. No.: 10/035,153

(22) Filed: Jan. 4, 2002

(65) Prior Publication Data

US 2002/0096096 A1 Jul. 25, 2002

(30) Foreign Application Priority Data

Jan. 24, 2001 (IT) ..... MI2001A0126

(51) Int. Cl.[7] ..... D05B 47/00; D05B 1/04
(52) U.S. Cl. ..... 112/254; 112/173
(58) Field of Search ..... 112/254, 248, 112/201, 189, 181, 173, 227, 261, 222, 224

(56) References Cited

U.S. PATENT DOCUMENTS 18,522 A * 10/1857 Roper
3,238,903 A * 3/1966 Pav
4,122,787 A * 10/1978 Conti
4,541,350 A * 9/1985 Ketterer
4,821,661 A * 4/1989 Brownlee

* cited by examiner

*Primary Examiner*—Ismael Izaguirre
(74) *Attorney, Agent, or Firm*—Guido Modiano; Albert Josif; Daniel O'Byrne

(57) ABSTRACT

A sewing machine for forming running-stitch seams, comprises a needle provided, proximate to its tip, with an open eye and orientated so that its axis is substantially perpendicular to a surface for supporting the item being sewn. The needle is actuated with a reciprocating motion along its own axis passing cyclically through the supporting surface. A thread take-up wheel is provided below the supporting surface and is composed of a fixed part, with a magazine for the taken-up thread, and a rotatable part, rotationally actuated about its own axis. The rotatable wheel part supports a lower looper engaging the thread loop below the supporting surface to load the thread in the magazine formed in the wheel fixed part. Pneumatic tensioning means for the thread portion lying below the supporting surface are further provided.

5 Claims, 4 Drawing Sheets

SEWING MACHINE FOR FORMING RUNNING-STITCH SEAMS, WITH HIGHLY REGULAR STITCH FORMING

BACKGROUND OF THE INVENTION

The present invention relates to a sewing machine for forming running-stitch seams.

Sewing machines for forming a seam with a so-called running stitch are known; such seam is formed with a single thread of preset length, known as draw, and is composed of stitches that are alternately visible on either side of the fabric being sewn.

A machine of this kind is disclosed in U.S. Pat. No. 4,122,787 and is substantially composed of a needle that has a substantially vertical axis and is provided, proximate to its tip, with an open eye and is orientated so that its axis is substantially perpendicular to a supporting surface on which the item being sewn is deposited.

The needle can be actuated with a reciprocating motion along its axis in order to pass cyclically through the item deposited on the supporting surface. Below the supporting surface there is a thread take-up wheel, which is arranged on a plane that is substantially parallel to the axis of the needle and is orientated so that its axis is substantially perpendicular to the axis of the needle. Such wheel is composed of a fixed part, in which there is a magazine for the taken-up thread, and a rotatable part, which can be actuated with a rotary motion about its own axis. The rotatable part of the wheel is mounted coaxially on an actuation shaft, which can be rotationally actuated about its own axis synchronously with the movement of the needle, and has, in a peripheral region, a looper or lower looper which, as a consequence of the rotation of the rotatable part of the wheel and of the movement of the needle, engages the thread carried below the supporting surface by the needle and takes it up, making it pass inside the magazine provided in the fixed part of the wheel.

The machine is completed by thread handling elements, which are located below the supporting surface, and by another looper, or upper looper, which is arranged above the supporting surface laterally to the needle and is adapted to engage the loop of thread carried by the needle above the supporting surface and retain it while it is taken up by the lower looper.

Substantially, this machine works with a draw of thread that is clamped at one of its ends. During a first step of the operating cycle, the needle, threaded with the thread proximate to its clamped end, passes through the item being sewn, carrying a loop of thread below the supporting surface.

Said loop of thread is engaged by the lower looper as a consequence of the rotation of the rotatable part of the wheel, and all the excess thread of the draw is loaded into the magazine located in the fixed part of the wheel and disengaged from the needle, which is extracted above the supporting surface.

After the item being sewn has been advanced by one step, the needle descends again with its eye below the supporting surface and engages the thread, carrying in the subsequent return step a loop of thread above the item being sewn. This loop of thread is engaged by the upper looper and, after the item has been advanced by another step, the needle again passes through the item, carrying a loop of thread below the supporting surface. Said loop of thread is engaged by the lower looper and disengaged from the needle. The lower looper, by continuing its rotation, takes up the portion of thread that lies between the eye of the needle and the free end of the draw, extracting it and reloading it into the magazine of the fixed part of the wheel. In this manner, the machine produces a seam with a single thread composed of stitches that are alternatively visible on the outer side and inner side of the item being sewn, i.e. a seam formed with so-called running stitches.

Over time, this machine has proved to be susceptible of improvements aimed mainly at improving the quality and precision of the seam.

SUMMARY OF THE INVENTION

The aim of the present invention is to provide a sewing machine for forming running-stitch seams that ensures highly regular execution of the stitches.

Within this aim, an object of the invention is to provide a sewing machine for forming running-stitch seams that ensures a substantially uniform tension of the thread during the forming of the stitches.

Another object of the invention is to provide a sewing machine for forming running-stitch seams that can use for the seam almost the entire length of the draw of thread, thus allowing to save both time and material.

Another object of the invention is to provide a sewing machine that can be obtained, with modifications that are relatively simple to provide and have a modest cost, from known types of sewing machine for forming running-stitch seams.

This aim and these and other objects that will become better apparent hereinafter are achieved by a sewing machine for forming running-stitch seams, comprising a needle provided, proximate to its tip, with an open eye and orientated so that its axis is substantially perpendicular to a surface for supporting the item being sewn, said needle being actuatable with a reciprocating motion along its own axis in order to pass cyclically through said supporting surface and the item being sewn; a thread take-up wheel being provided below said supporting surface, being arranged on a plane that is substantially parallel to the axis of said needle and being orientated so that its axis is substantially perpendicular to the axis of said needle; said wheel being composed of a fixed part, in which there is a magazine for the taken-up thread, and a rotatable part, which can be rotationally actuated about its own axis; said rotatable part of the wheel being mounted coaxially on an actuation shaft that can be rotationally actuated about its own shaft axis synchronously with the movement of said needle and being provided with a lower looper that can engage the loop of thread carried below said supporting surface by said needle in order to load the thread in said magazine formed in the fixed part of the thread take-up wheel; characterized in that it comprises tensioning means for the pneumatic tensioning of the portion of thread that lies below said supporting surface between the item being sewn and said taken-up thread magazine.

BRIEF DESCRIPTION OF THE DRAWINGS

Further characteristics and advantages of the invention will become better apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
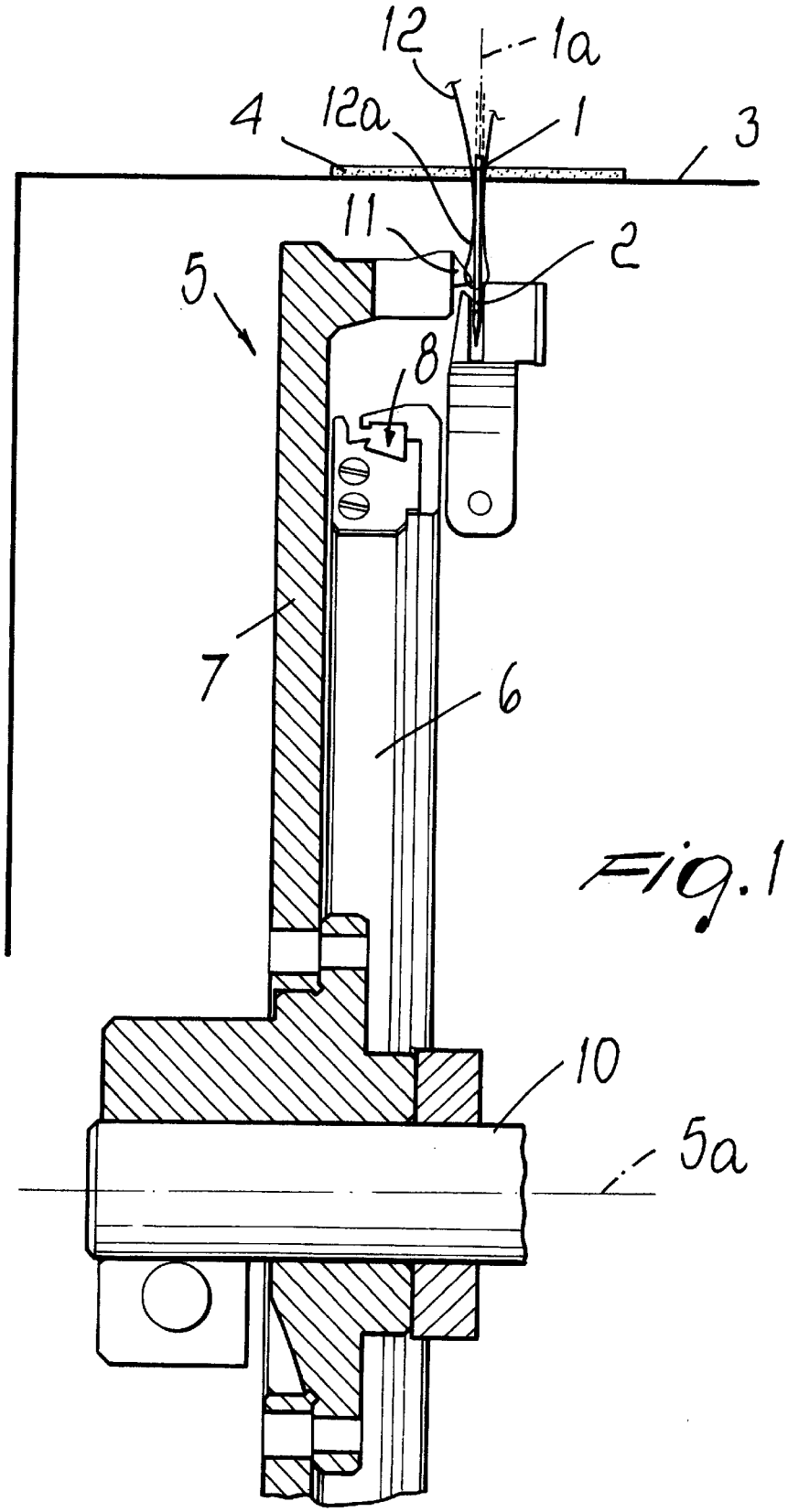
FIG. 1 is a front elevation view of some of the elements that compose the machine according to the invention, arranged below the supporting surface of the item being sewn, with the fixed part of the thread take-up wheel shown only partially.
Figure 2:
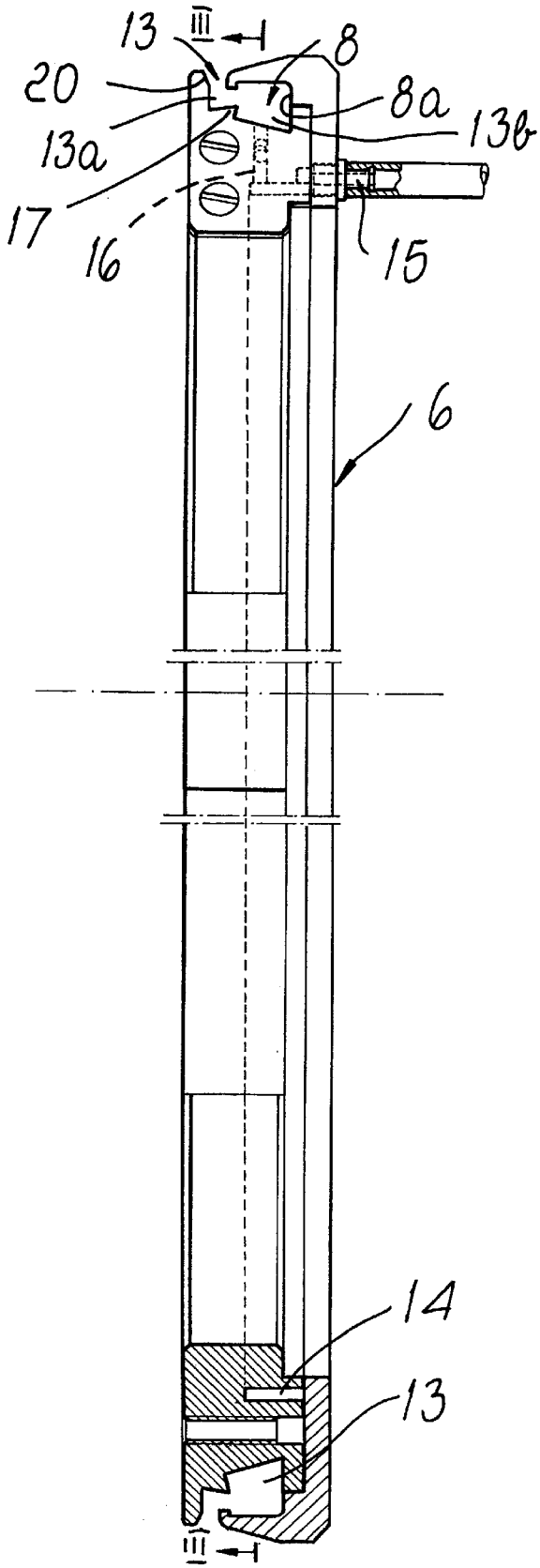
FIG. 2 is a partially sectional enlarged-scale front elevation view, similar to FIG. 1, of the fixed part of the thread take-up wheel.
Figure 3:
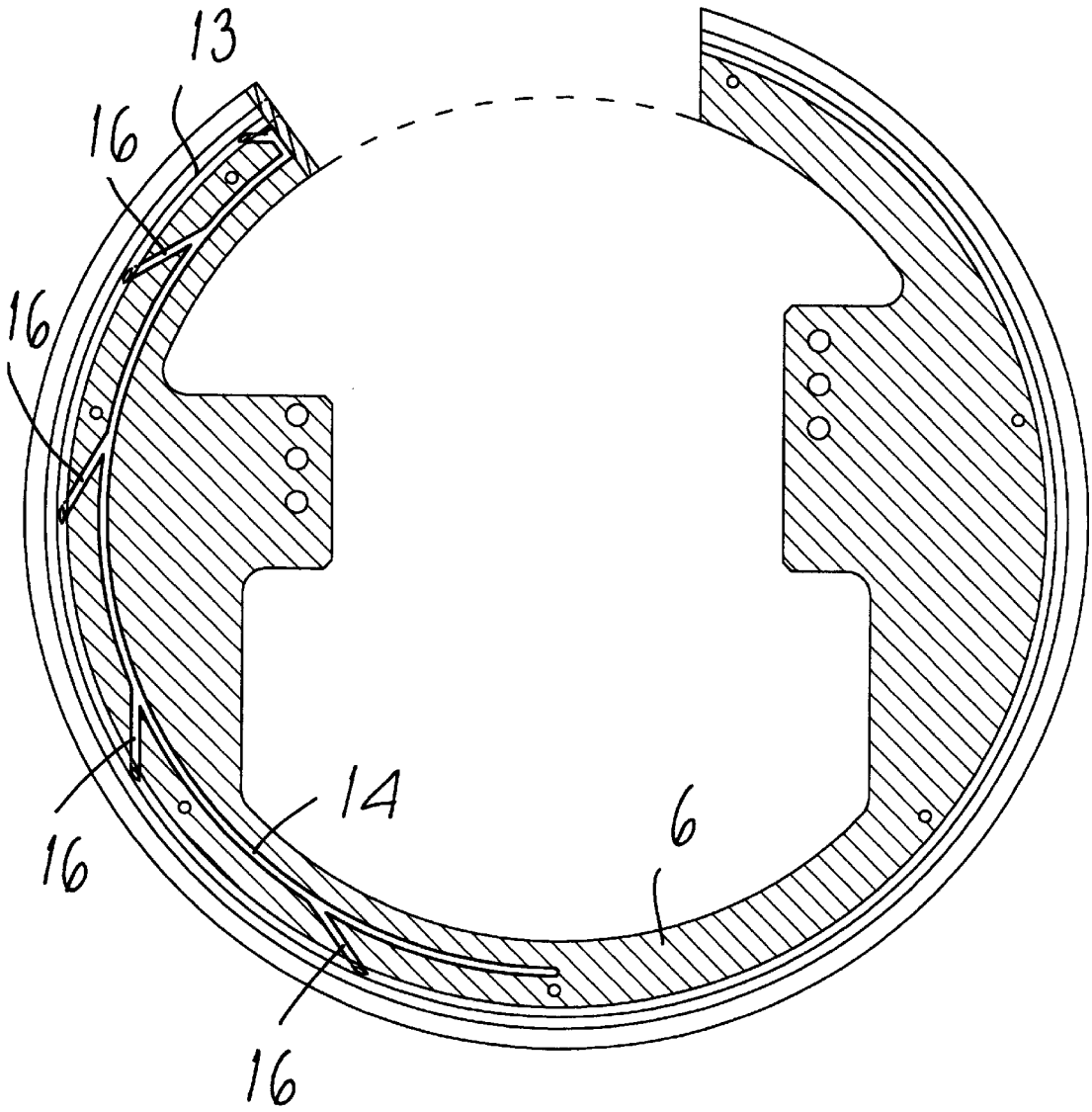
FIG. 3 is a reduced-scale sectional view of FIG. 2, taken along the line III—III.
Figure 4:
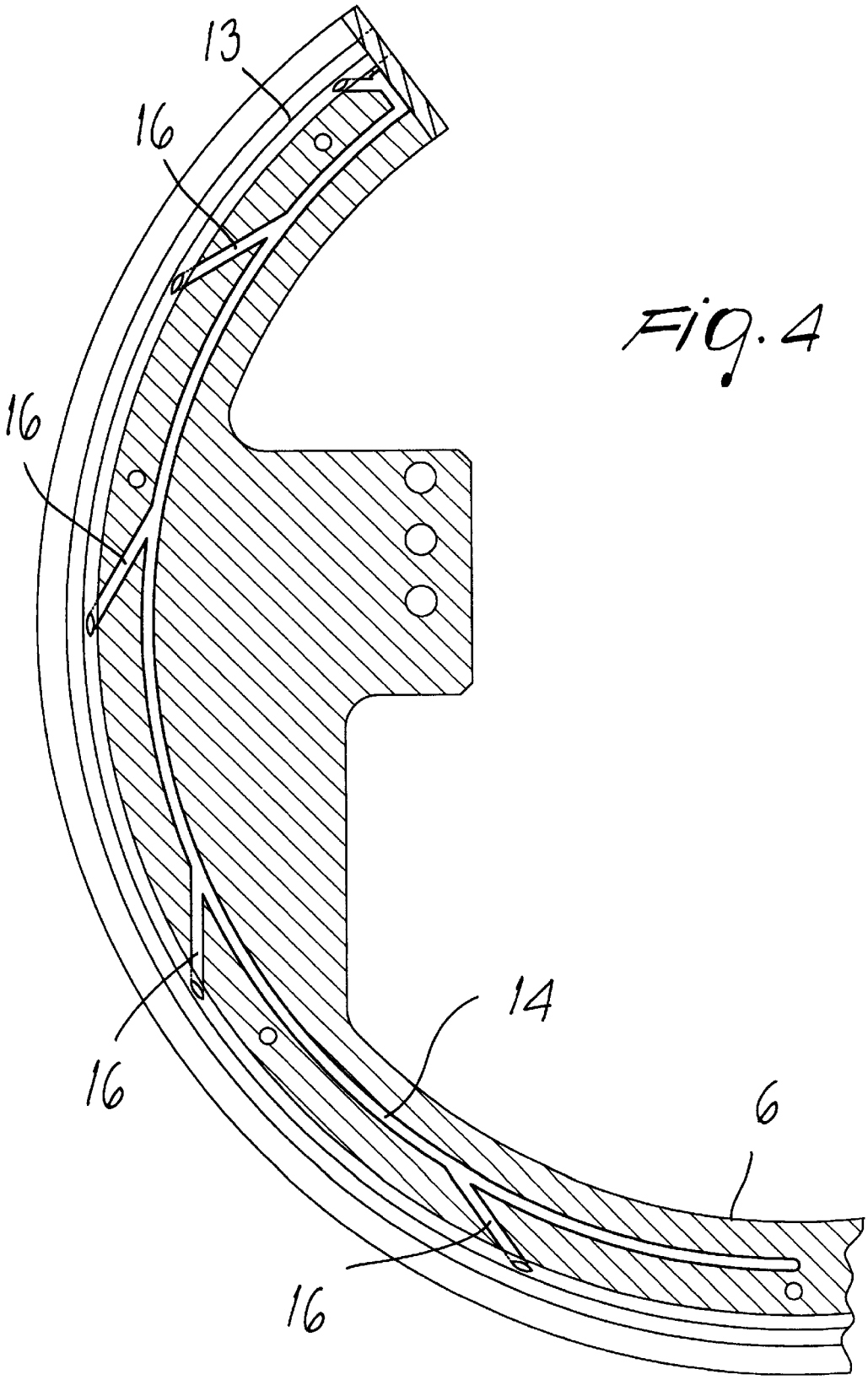
FIG. 4 is an enlarged-scale view of a detail of FIG. 3.

With reference to the figures, the machine according to the invention, shown only partially for the sake of simplicity, comprises in a per se known manner a needle 1 that has, proximate to its tip, an eye 2 that is open at the front and is orientated so that its axis 1*a* is substantially perpendicular to a supporting surface 3 for the item 4 being sewn.

The needle 1 can be actuated with a reciprocating motion along its axis 1*a*, which is preferably orientated vertically, in order to pass cyclically through the supporting surface 3, which is preferably arranged horizontally.

Below the supporting surface 3 there is a thread take-up wheel, generally designated by the reference numeral 5, which is arranged on a plane that is substantially parallel to the axis 1*a* of the needle 1 and is orientated so that its axis 5*a* is substantially perpendicular to the axis 1*a* of the needle 1.

The wheel 5 is composed of a fixed part 6 and a rotatable part 7, which can be rotationally actuated about the axis 5*a*. The fixed part 6 of the wheel 5 has a circular contour around the axis 5*a*, with a discontinuity along its contour. Said discontinuity is located proximate to the working area of the needle 1.

Proximate to the peripheral region of the fixed part 6 of the wheel 5 there is a magazine 8 for the taken-up thread, with an inlet 8*a* located at one of the ends of the fixed part 6 at said discontinuity.

The rotatable part 7 of the wheel is mounted coaxially on an actuation shaft 10, which can be rotationally actuated about its own axis, which coincides with the axis 5*a*, synchronously with the movement of the needle 1. The rotatable part 7 supports a looper 11, which constitutes the lower looper of the machine and can engage a portion 12*a* of the thread 12 that protrudes from the eye 2 along one side of the needle 1 when the thread 12 is carried by the needle 1 below the supporting surface 3 after passing through the item 4 being sewn, which rests on the supporting surface 3.

According to the invention, the sewing machine comprises pneumatic tensioning means for tensioning the portion of thread 12 that lies below the supporting surface 3 between the item 4 being sewn and the magazine 8 for the taken-up thread.

More particularly, the magazine 8 comprises a channel 13, which traces a circular path around the axis 5*a* and is formed proximate to the perimeter of the fixed part 6 of the wheel 5. Said channel 13 is open at the discontinuity of the fixed part 6 of the wheel 5 and on the lateral surface of said fixed part 6.

The pneumatic tensioning means comprises means for injecting a stream of pressurized air into the channel 13 in a direction that corresponds to the direction in which the thread 12 is loaded into the channel 13 by the lower looper 11.

Preferably, the air injection means comprises an air supply duct 14, which is formed in the fixed part 6 of the wheel 5. Said duct 14, which runs preferably along an arc that is centered on the axis 5*a* and has a smaller radius than the channel 13, can be connected by means of a connector 15, connected to the fixed part 6, to means for supplying pressurized air, such as for example a pressurized air distribution line or a compressor.

The duct 14 is communicated with the channel 13 through at least one delivery duct 16. The outlet of the delivery duct 16 into the channel 13 is orientated in a delivery direction that corresponds to the direction in which the thread 12 is inserted in the channel 13 by the lower looper 11.

Preferably, multiple delivery ducts 16 are provided which start from the duct 14 and lead into the channel 13, with delivery directions that correspond to the direction in which the thread 12 is inserted in the channel 13 by the lower looper 11.

The channel 13 has, on its side directed toward the axis 5*a*, a raised portion 17 that partially divides the channel 13 into two contiguous portions: a first portion 13*a*, which is closer to the rotatable part 7 and is contiguous to the lateral opening 20 of the channel 13, and a second portion 13*b*, which is located further away from the rotatable part 7. These two portions 13*a* and 13*b* are in any case mutually connected so as to allow the thread 12, inserted in the channel 13 through the lateral opening 20 as a consequence of the rotation of the looper 11, to pass from the portion 13*a* to the portion 13*b*. The delivery ducts 16 lead into the second part 13*b* of the channel 13.

The machine is completed by thread handling elements, which are located below the supporting surface 3, and by another looper, or upper looper, which is arranged above the supporting surface 3 laterally to the needle 1 and is meant to engage the thread carried by the needle 1 above the supporting surface 3 and retain it when it is taken up by the lower looper 11, for example as disclosed and illustrated in U.S. Pat. No. 4,122,787. Said thread handling elements have not been illustrated for the sake of simplicity.

As regards the formation of the stitches, the sewing machine according to the invention operates substantially like the machine disclosed in U.S. Pat. No. 4,122,787, except that when the thread 12 is loaded into the channel 13, the pressurized air delivered inside said channel 13, through the ducts 16, tensions the thread 12 and this tension is transmitted to the portion of thread that lies between the item 4 being sewn and the channel 13.

Through this tension, abnormal slackening of the thread 12 is avoided and the stitches are more regular.

Furthermore, thanks to the tensioning of the thread 12, the machine according to the invention can use, for sewing, almost the entire length of the draw of thread, thus reducing the number of draws required to form a seam and also reducing the sewing time and the amount of thread that is required.

It should also be noted that the pneumatic tensioning of the thread 12 facilitates its arrangement within the portion 13*a* while it is loaded in the fixed part 6 by the rotatable part 7 and its arrangement inside the portion 13*b* while it is extracted from the fixed part 5. In this manner one avoids interference between the portion of thread 12 that enters the magazine 8 and the portion of thread 12 that exits from the magazine 8.

In practice it has been found that the sewing machine according to the invention fully achieves the intended aim and objects, since it ensures high regularity in the formation of the stitches by way of the pneumatic tensioning of the sewing thread.

The sewing machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2001A000126 from which this application claims priority are incorporated herein by reference.

What is claimed is:

1. A sewing machine for forming running-stitch seams, comprising a needle having a tip and provided, proximate to the tip, with an open eye and orientated with a needle axis thereof substantially perpendicular to a surface for supporting of an item being sewn, said needle being actuatable with a reciprocating motion along said needle axis in order to pass cyclically through said supporting surface and the item being sewn; a thread take-up wheel provided below said supporting surface, arranged on a plane that is substantially parallel to the needle axis and being orientated with a wheel axis thereof substantially perpendicular to the needle axis; said wheel being composed of a fixed part, enclosing a magazine for the taken-up thread, and of a rotatable part, which is rotationally actuatable about the wheel axis; an actuation shaft that is rotationally actuatable about a shaft axis thereof synchronously with a movement of said needle, said rotatable part of the wheel being mounted coaxially on said actuation shaft and being provided with a lower looper that engages a loop of thread carried below said supporting surface by said needle in order to load the thread in said magazine formed in the fixed part of the thread take-up wheel; and tensioning means for pneumatic tensioning of a portion of thread that lies below said supporting surface between the item being sewn and said taken-up thread magazine.

2. The sewing machine of claim 1, wherein said fixed part of the wheel traces a circular path around the shaft axis of said actuation shaft, with a discontinuity around a working area of said needle; said taken-up thread magazine comprising a circular channel formed proximate to the perimeter of the fixed part of the wheel, with an inlet of the taken-up thread magazine being formed at said discontinuity; said pneumatic tensioning means comprising injecting means for injecting a stream of pressurized air into said circular channel in a direction that corresponds to a loading direction of the thread into said circular channel by said lower looper.

3. The sewing machine of claim 2, comprising pressurized air supplying means and at least one air delivery duct that leads into said circular channel with a delivery direction that corresponds to the loading direction of the thread into said circular channel by said lower looper, said air injection means comprising an air supply duct, which is formed in said fixed part of the thread take-up wheel and is connectable to said pressurized air supplying means, said supply duct being connected to said at least one delivery duct.

4. The sewing machine of claim 3, wherein of plurality of air delivery ducts are provided, said air supply duct being connected to said plurality of air delivery ducts that lead into said circular channel with delivery directions that correspond to the loading direction of the thread into said channel by said lower looper.

5. The sewing machine of claim 3, comprising an intermediate raised portion that divides said circular channel into two mutually connected contiguous portions, said contiguous portions comprising a first portion, which is open laterally along the perimeter of said fixed part of the wheel and is proximate to said rotatable part of the wheel, and a second portion, which lies further away from said rotatable part of the wheel with respect to said first portion, said at least one air delivery duct ending in said second portion of the circular channel.

* * * * *